91-452 SR
10/22/85 XR 4,548,296

United States Patent [19]
Hasegawa

[11] Patent Number: 4,548,296
[45] Date of Patent: Oct. 22, 1985

[54] HYDRAULIC ELEVATOR

[75] Inventor: Kisaku Hasegawa, Tokyo, Japan
[73] Assignee: Oil Drive Kogyo, Ltd., Tokyo, Japan

[21] Appl. No.: 568,521
[22] Filed: Jan. 6, 1984

Related U.S. Application Data

[63] Continuation of Ser. No. 315,235, Oct. 26, 1981, abandoned, which is a continuation of Ser. No. 149,507, May 13, 1980, abandoned.

[30] Foreign Application Priority Data

Feb. 26, 1980 [JP] Japan ..... 55-23263

[51] Int. Cl.[4] ..... B66B 11/04
[52] U.S. Cl. ..... 187/17; 91/452; 137/486
[58] Field of Search ..... 187/17, 28, 38, 68; 91/449, 452, 400, 404, 433; 137/486

[56] References Cited

U.S. PATENT DOCUMENTS

| | | | |
|---|---|---|---|
| 3,105,573 | 10/1963 | Leveski | 187/38 |
| 3,141,386 | 7/1964 | Loughridge | 91/449 |
| 3,363,514 | 1/1968 | Ramoke | 91/449 |
| 3,842,943 | 10/1974 | Nakamura et al. | 187/17 |
| 4,031,813 | 6/1977 | Walters et al. | 91/433 |
| 4,205,592 | 6/1980 | Haussler | 91/449 |
| 4,412,600 | 11/1983 | Ito et al. | 187/17 |

FOREIGN PATENT DOCUMENTS

| | | | |
|---|---|---|---|
| 2618046 | 10/1977 | Fed. Rep. of Germany | 187/17 |

*Primary Examiner*—H. Grant Skaggs
*Assistant Examiner*—Kenneth Noland
*Attorney, Agent, or Firm*—Armstrong, Nikaido, Marmelstein & Kubovcik

[57] ABSTRACT

This invention relates to a hydraulic elevator wherein working oil is transferred from a tank to a jack or vice versa by means of a hydraulic pump which is driven by an electric motor, so as to cause the elevator to ascend and descend; characterized in that a hydraulic circuit is equipped with electronically-controlled variable flow solenoid valves which set flow rates of the working oil in accordance with a program for electronic control in correspondence with respective stages of stop, slow speed ascent, full speed ascent, slow speed descent and full speed descent of the elevator.

3 Claims, 6 Drawing Figures

HYDRAULIC ELEVATOR

This aplication is a continuation of application Ser. No. 315,235 filed Oct. 26, 1981, now abandoned which in turn is a continuation of Ser. No. 149,507 filed May 13, 1980 now abandoned.

DESCRIPTION OF THE PRIOR ART

In a ram type hydraulic elevator wherein a ram is raised or lowered by driving a jack for the ram by means of an electric motor through a variable capacity type hydraulic pump, the inventor of this invention has previously provided a system wherein a cage type induction motor is employed as the aforecited electric motor and wherein at the rise of the ram, the variable capacity type hydraulic pump which has its capacity adjusted in the direction of feeding working oil to the jack as a motor is driven thereby to transfer the working oil to the jack, while at the fall of the ram, the variable capacity type hydraulic pump whose capacity is adjusted in the direction of pulling the working oil out of the jack is driven with the energy of fall of the elevator, this pump drive being used for forcibly driving the induction motor so as to operate it as an induction generator.

According to this system, the great portion of the falling energy of the elevator during the descent thereof can be recovered as generative power in the induction motor operated as the induction generator and then be fed back to a power supply. Therefore, the system has the feature that a sharp saving in electric power energy becomes possible.

The system, however, requires the variable capacity type hydraulic pump and a capacity varying device for varying the capacity thereof, resulting in the disadvantage that these devices are very expensive as compared with a constant capacity type hydraulic pump adopted in this invention and the disadvantage that the capacity of the variable capacity type hydraulic pump is difficult to be made large, so a large-sized hydraulic elevator cannot be fabricated.

SUMMARY OF THE INVENTION

This invention intends to eliminate the disadvantages as described before, and consists in a hydraulic elevator wherein working oil is transferred from a tank to a jack or vice versa by means of a hydraulic pump which is driven by an electric motor, so as to cause the elevator to ascend or descend, characterized in that a constant capacity type hydraulic pump is employed as the aforecited hydraulic pump and that a cage type induction motor is employed as the aforecited electric motor, the induction motor being operated as an induction generator during the descent of the elevator so as to feed its generative electric power back to a power supply, whereby the expected result is achieved.

In addition, this invention is so constructed that a hydraulic circuit of a hydraulic elevator is provided with electronically-controlled variable flow solenoid valves which set flow rates of working oil in accordance with a program for electronic control in correspondence with respective stages of stop, slow speed ascent, full speed ascent, slow speed descent and full speed descent of the elevator, and that when the flow rate of the working oil has deviated from a set value, a flowmeter disposed in the hydraulic circuit detects the deviation of the flow rate of the working oil from the set value as a feedback signal, the opening and closure of the electronically-controlled variable flow solenoid valves being automatically adjusted with the feedback signal in order to regulate the flow rate of the working oil to the set value. Herein, a cage type induction motor is employed as an electric motor for driving a hydraulic pump and is operated as an induction generator during the descent of the elevator so as to feed its generative electric power back to a power supply, whereby electric power energy can be sharply saved.

Further, in the hydraulic elevator of the system wherein the flow rates of the working oil are set in accordance with the program for electronic control, this invention appropriately disposes limit switches in correspondence with the respective elevator stages of the program for electronic control, thereby permitting a more smooth and efficient operation of the hydraulic elevator.

EMBODIMENTS

Hereunder, embodiments illustrated in the accompanying drawings will be particularly described in order to explain the hydraulic elevator of this invention more in detail.

EMBODIMENT 1

Figure 1:
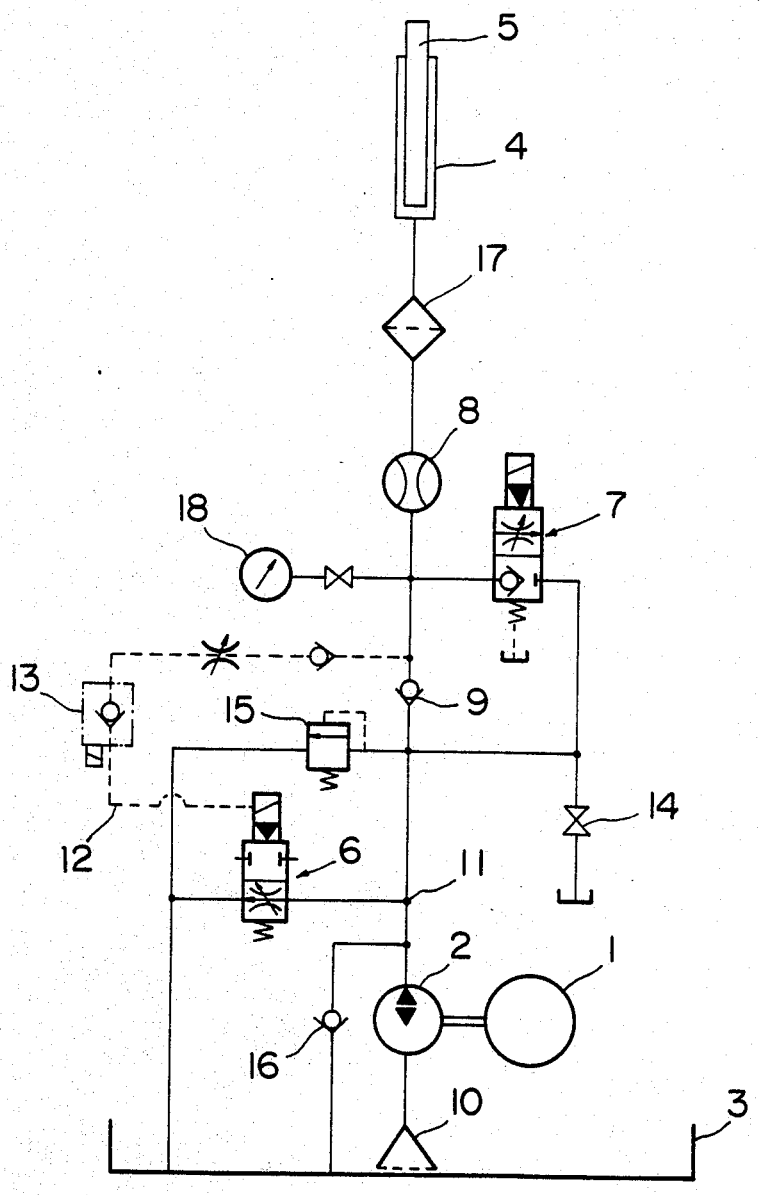
FIG. 1 illustrates a hydraulic circuit diagram showing Embodiment (1) according to the hydraulic elevator of this invention.

FIG. 1 shows Embodiment 1 according to the hydraulic elevator of this invention. It is a ram type hydraulic elevator wherein working oil is transferred from a tank 3 to a jack 4 or vice versa by means of a constant capacity type hydraulic pump 2 driven by a cage type induction motor 1, to move a ram 5 for the jack 4 up or down, thereby causing the elevator to ascend or descend.

The hydraulic elevator of this invention has its hydraulic circuit equipped with electronically-controlled variable flow solenoid valves 6 and 7 which set the flow rates of the working oil in correspondence with the respective stages of stop, slow speed ascent, full speed ascent, slow speed descent and full speed descent of the elevator.

When the flow rate of the working oil has deviated from a set value, a flowmeter 8 disposed in the hydraulic circuit detects the deviation of the working oil flow rate from the set value as a feedback signal, and this feedback signal is used for automatically adjusting the opening and closure of the electronically-controlled variable flow solenoid valves 6 and 7 in order to regulate the working oil flow rate to the set value.

Now, the operating functions of this hydraulic elevator will be successively explained of the respective stages of the stop, the slow speed ascent, the full speed ascent, the slow speed descent and the full speed descent of the elevator.

(A) Stage of Stop of Elevator

A power supply to the cage type induction motor 1 shown in FIG. 1 is open. The electronically-controlled variable flow solenoid valve for ascent 6 and the electronically-controlled variable flow solenoid valve for descent 7 have a control voltage V which is now zero, and the former is fully open, while the latter is fully closed.

Accordingly, the working oil is not transferred from the tank 3 to the jack 4. In addition, that movement of the working oil from the jack 4 to the tank 3 which is attendant upon the natural fall of the elevator is checked by a non-return valve 9. Therefore, the elevator is in the perfectly stopped state.

(B) Stage of Slow Speed Ascent (Accelerating Ascent) of Elevator

The cage type induction motor 1 shown in FIG. 1 is started. The constant capacity type hydraulic pump 2 is driven by the forward rotation of the motor 1 so as to transfer the working oil from the tank 3 to the hydraulic circuit 11 through a filter for suction 10.

At the starting of the electric motor 1, the electronically-controlled variable flow solenoid valve for ascent 6 is fully open. Accordingly, the working oil is returned to the tank 3 through the variable flow solenoid valve 6, so that an oil pressure for raising the ram 5 is not generated in the jack 4.

Figure 2:
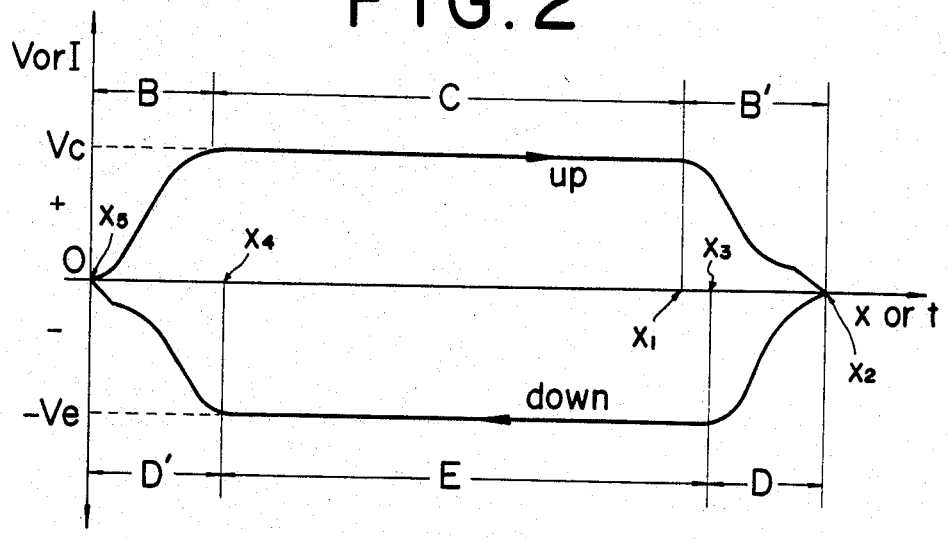
FIG. 2 illustrates a chart showing a program for electronic control employed in the hydraulic elevator of this invention.

The variable flow solenoid valve 6 is operated in accordance with a program for electronic control shown in FIG. 2. The axis of ordinates represents the control voltage V or current I for electronically controlling the variable flow solenoid valve 6, while the axis of abscissas represents the movement distance x or time t of the elevator.

As illustrated in FIG. 2, at the starting of the electric motor 1 (a position of $x=0$ or $t=0$), the voltage V is zero, and the variable flow solenoid valve 6 is fully open. As the voltage V increases in the positive direction, the variable flow solenoid valve 6 is gradually closed.

Accordingly, when the variable flow solenoid valve 6 is operated by a program section B corresponding to the slow speed ascent stage in FIG. 2, the oil pressure for raising the ram 5 does not appear in the jack 4 at the starting of the electric motor 1 because the variable flow solenoid valve 6 is fully open and all the working oil transferred by the constant capacity type hydraulic pump 2 is returned to the tank 3. With the increase of the control voltage V of the variable flow solenoid valve 6, however, this valve 6 is gradually closed, and the flow rate of the working oil which is transferred to the jack 4 through the non-return valve 9 increases, to generate the oil pressure for raising the ram 5.

With the increase of the voltage V, the ram 5 has its rising speed enhanced and brings the elevator into the accelerating slow speed ascent.

(C) Stage of Full Speed Ascent of Elevator

In case where the variable flow solenoid valve 6 is operated by a program section C corresponding to the full speed ascent stage in FIG. 2, the voltage V is held constant at its maximum voltage $V_c$, and hence, the variable flow solenoid valve 6 is held in the fully closed state or a slightly open state. In consequence, the elevator having been accelerated in the slow speed ascent stage comes to ascend at the full speed of a fixed speed.

The speed of the elevator during the full speed ascent can be adjusted to an appropriate value by properly setting the maximum voltage $V_c$ corresponding to the speed.

(B') Stage of Slow Speed Ascent (Decelerating Ascent) of Elevator

When the elevator has performed the full speed ascent to a position $x_1$ immediately below a floor intended to stop, the variable flow solenoid valve 6 receives a deceleration signal. That is, the valve 6 is operated in accordance with a program section B' in FIG. 2.

The voltage V decreases from the maximum voltage $V_c$, and the variable flow solenoid valve 6 is consequently opened. Thus, the flow rate of the working oil to be transferred to the jack 4 decreases, and the ascending speed of the elevator lowers.

The elevator ascends up to a stop position $x_2$ of the floor intended-to-stop while decelerating and then stops thereat.

At this time, the electric motor 1 rotates for several seconds even after the elevator has reached the stop position $x_2$, whereupon it stops.

As described above, the elevator of this invention is operated very smoothly in accordance with the program of FIG. 2 from the starting via the accelerating ascent, the constant full speed ascent and the decelerating ascent to the stop.

(D) Stage of Slow Descent (Accelerating Descent) of Elevator

The electronically-controlled variable flow solenoid valve for descent 7 is operated by a program section D corresponding to the slow speed descent stage in the program for electronic control illustrated in FIG. 2. The variable flow solenoid valve 7 is constructed so as to gradually open as the control voltage V increases in the negative direction.

Simultaneously with the operation of the variable flow solenoid valve 7, an electromagnetic non-return valve 13 which is installed in a pilot circuit 12 for the electronically-controlled variable flow solenoid valve for ascent 6 is actuated to open and to apply an oil pressure to the pilot circuit 12 so as to close the electronically-controlled variable flow solenoid valve for ascent 6. Therefore, in case where the variable flow solenoid valve 7 is operated in accordance with the program section D in FIG. 2 and is gradually opened with the increase of the voltage V in the negative direction, the working oil is transferred by a gravity on the elevator from the jack 4 through the variable flow solenoid valve 7 to the tank 3 while rotating and driving the constant capacity type hydraulic pump 2 and the electric motor 1 in the directions reverse to those during the ascent of the elevator.

The elevator carries out the accelerating slow speed descent with the increase of the voltage V in the negative direction, and the constant capacity type hydraulic pump 2 is driven by the falling energy at this time.

When the elevator has descended from the stop position $x_2$ down to any desired position $x_3$ (corresponding to a point of time when the flow rate of the working oil which is returned from the jack 4 to the tank 3 by the rotation of the electric motor 1 is the maximum, in other words, a point of time when the descending speed is the maximum), the cage type induction motor 1 is operated.

This cage type induction motor 1 is forcibly driven by the hydraulic pump 2 and functions as an induction generator, so that the falling energy of the elevator can be converted into generative power in the induction generator.

(E) Stage of Full Speed Descent of Elevator

In case where the variable flow solenoid valve 7 is operated by a program section E corresponding to the full speed descent stage in FIG. 2, the voltage V is held constant at its maximum voltage $-V_e$, and the variable flow solenoid valve 7 is held in the fully open state or a slightly closed state. The elevator having been accelerated in the slow speed descent stage descends at the full speed of a constant speed, and the cage type induction motor 1 to operate as the induction generator is driven through the constant capacity type hydraulic pump 2 by the falling energy, to generate the electric power.

The speed of the elevator during the full speed descent can be set at an appropriate value by properly setting the maximum voltage $-V_3$. Needless to say, it is set in a range in which the flow rate of the working oil to pass through the variable flow solenoid valve 7 becomes greater than the flow rate of the working oil to be returned to the tank 3 by the hydraulic pump 2.

(D') Stage of Slow Speed Descent (Decelerating Descent) of Elevator

When the elevator has descended at the full speed down to a position $x_4$, the variable flow solenoid valve 7 receives a deceleration signal, and it is operated in accordance with a program section D' in FIG. 2.

As the absolute value of the voltage V decreases from the maximum voltage $V_e$, the variable flow solenoid valve 7 is closed, and the flow rate of the working oil to be transferred from the jack 4 to the tank 3 decreases. The elevator has its descending speed lowered, and stops at a stop position $x_5$.

At this time, the electric motor 1 is deenergized at a position between $x_4$ and $x_5$ (a point of time when the elevator becomes slower than at $x_4$), and the voltage of the electromagnetic non-return valve 13 is cut off.

As described above, the elevator of this invention is operated very smoothly in accordance with the program for electronic control in FIG. 2 from the decelerating descent via the constant full speed descent to the decelerating descent.

As set forth above, the elevator of this invention is so constructed that the flow rates of the working oil to flow through the electronically-controlled variable flow solenoid valve for ascent 6 or the electronically-controlled variable flow solenoid valve for descent 7 are set in correspondence with the respective stages of the stop, the slow speed ascents B and B', the full speed ascent C, the slow speed descents D and D' and the full speed descent E of the elevator in the program for electronic control in FIG. 2. Moreover, in case where at the stop, ascent or descent of the elevator, the elevator has rapidly risen or rapidly fallen and the flow rate of the working oil has deviated from a set value on account of an unexpected trouble of any of the hydraulic pump, piping, the electric motor, the valve etc., the deviation of the working oil flow rate from the set value is detected as the feedback signal by means of the flowmeter 8, and the opening and closure of the electronically-controlled variable flow solenoid valve for ascent 6 or the electronically-controlled variable flow solenoid valve for descent 7 can be automatically adjusted with the feedback signal in order to regulate the flow rate of the working oil to the set value. Therefore, the operation of the elevator becomes still smoother, and a very excellent safety device is comprised.

Since the safety device employs the electronically-controlled variable flow solenoid valves, it is remarkably quick in response and high in reliability as compared with mechanical safety devices which have been often employed in conventional hydraulic elevators.

The safety device used in the hydraulic elevator of this invention functions very effectively at the following faults:

(a) Power has gone off in the course of the traveling of the elevator.
(b) The electric motor has become disconnected though power is kept conducted.
(c) The coupling between the electric motor and the hydraulic pump has ruined.
(d) The piping has severed.
(e) The control voltage is normal, but the driving side power supply is defective.

The hydraulic elevator of this invention can prevent noise, and can conspicuously reduce the pressure losses of the variable flow solenoid valves 6 and 7.

The hydraulic elevator of this invention can sharply save electric power in such a way that, during the descent of the elevator, the falling energy of the elevator is recovered as the generative power of the cage type induction motor 1 operated as the induction generator through the constant capacity type hydraulic pump 2 and is fed back to the power supply. In this regard, a more effective economy in power consumption is possible owing to the reduction of the pressure losses in the variable flow solenoid valves 6 and 7.

In conventional hydraulic elevators, the greater portion of the falling energy of the elevator has turned into heat and has raised the temperature of working oil. In contrast, in the hydraulic elevator of this invention, the falling energy of the elevator can be converted into the electric power and then recovered, so that the generation of heat is remarkably less and that the temperature rise of the working oil can be diminished.

Further, the hydraulic elevator of this invention adopts the constant capacity type hydraulic pump 2. Since the capacity of the hydraulic pump 2 can be made large, a large-sized hydraulic elevator can be fabricated. Moreover, the fabrication is inexpensive.

The hydraulic elevator of this invention is equipped with a manual operation valve for confirming safety 14. In a routine inspection, under the state under which the power supply of the electric motor 1 is turned "off", a signal for descent is applied to the variable flow solenoid valve 7 and the manual operation valve for confirming safety 14 is opened so as to cause the elevator to fall rapidly. Thus, whether or not the safety device functions properly can be inspected.

The safety confirming manual operation valve 14 serves, not only in the routine inspection, but also in an inspection and adjustment on the spot on which the elevator has been installed. The spot adjustment of the elevator can be simply carried out.

In Embodiment 1 shown in FIG. 1, numeral 15 designates a relief valve which determines the maximum pressure of the working oil, numeral 16 a check valve for preventing a negative pressure, numeral 17 a filter, and numeral 18 a pressure gauge.

Thus far, Embodiment 1 according to the hydraulic elevator of this invention has been described. In this embodiment, the electric motor 1 is constructed so as to forwardly rotate during the ascent of the elevator and to reversely rotate during the descent.

EMBODIMENT 2

Figure 3:
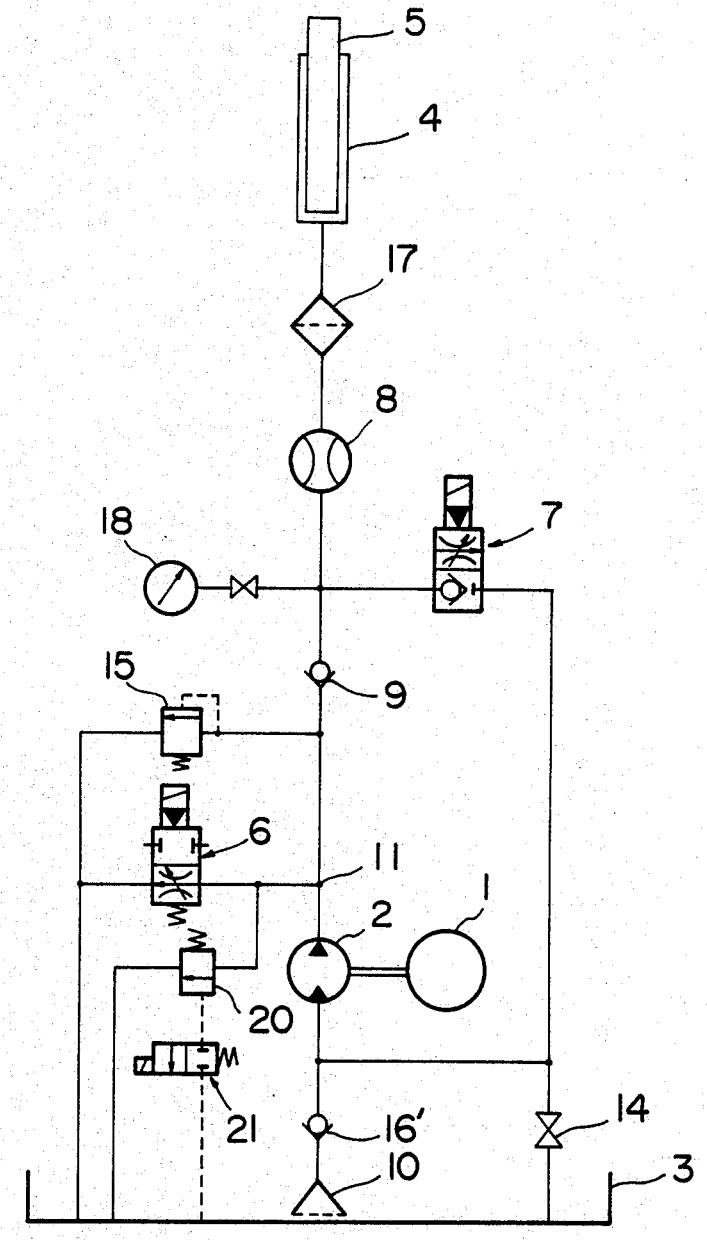
FIG. 3 illustrates a hydraulic circuit diagram showing Embodiment (2) according to the hydraulic elevator of this invention.

Now, Embodiment 2 according to the hydraulic elevator of this invention as is so constructed that the electric motor 1 is forwardly rotated during both the ascent and the descent of the elevator is shown in FIG. 3.

Hereunder, the operating functions of the hydraulic elevator of Embodiment 2 will be described.

As in the case of Embodiment 1, the hydraulic elevator is operated in accordance with the program for electronic control shown in FIG. 2.

The manner of the ascent of the elevator is the same as in Embodiment 1, and is therefore omitted from the description.

The manner of the descent of the elevator will be explained. The electronically-controlled variable flow solenoid valve for descent 7 operates in accordance with the program sections D, E and D' in FIG. 2. With the descent of the elevator, the working oil is transferred from the jack 4 to a hydraulic circuit 19 through the aforecited valve 7 and has its movement to the tank 3 checked by a non-return valve 16'. Therefore, the transferred working oil moves to the hydraulic circuit 11 while driving the constant capacity type hydraulic pump 2.

In this case, the electronically-controlled variable flow solenoid valve for ascent 6 has the control voltage of zero and is fully open. Accordingly, the working oil having moved to the hydraulic circuit 11 is transferred to the tank 3 through this variable flow solenoid valve 6.

The direction in which the constant capacity type hydraulic pump 2 is rotated and driven is forward as in the ascending operation of the elevator. Accordingly, also the cage type induction motor 1 which is operated as the induction generator rotates forwards to generate electric power.

In Embodiment 2 illustrated in FIG. 3, a hydraulic circuit which consists of a pilot type safety valve 20 and a spring offset type change-over valve 21 installed on the pilot circuit is a hydraulic circuit for preventing a negative pressure. During the descent of the elevator, the change-over valve 21 is actuated from its quiescent position to its operative position, and the function is effected.

EMBODIMENT 3

Figure 5:
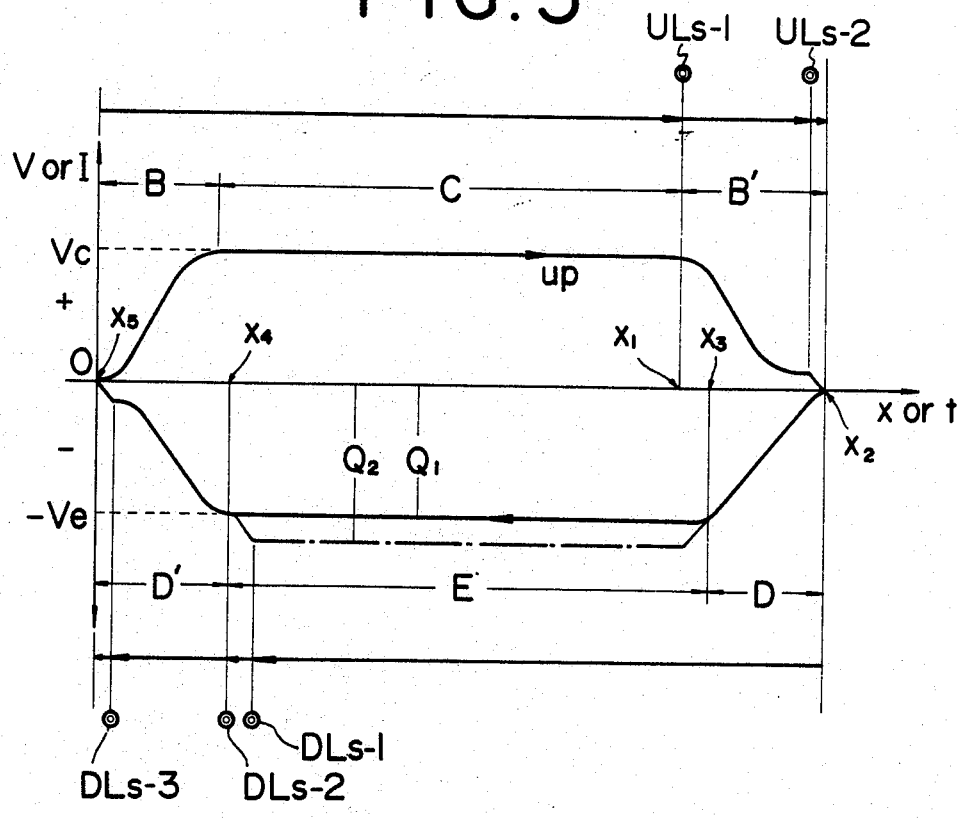
FIG. 5 illustrates a chart showing a program for electronic control employed in the hydraulic elevator of this invention.
Figure 4:
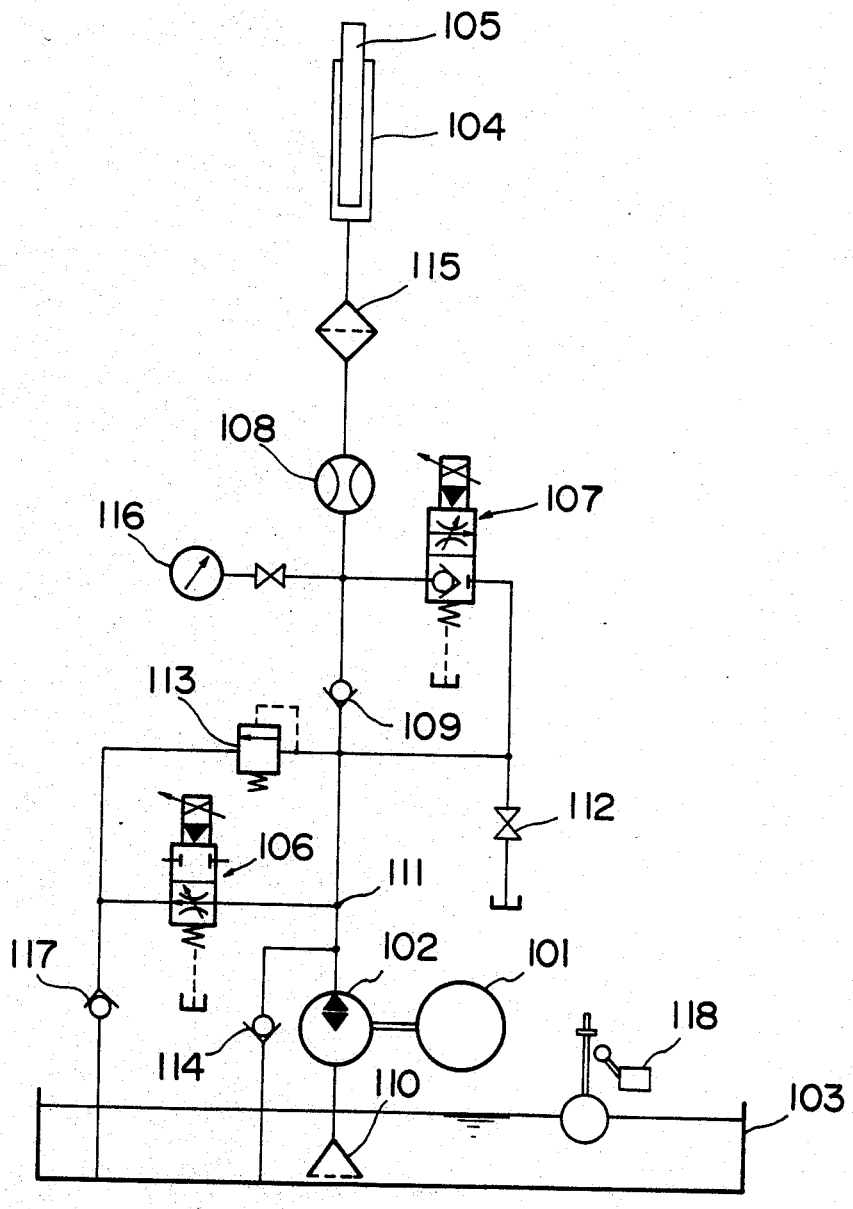
FIG. 4 illustrates a hydraulic circuit diagram showing Embodiment (3) according to the hydraulic elevator of this invention.

FIG. 4 shows Embodiment 3 according to the hydraulic elevator of this invention, while FIG. 5 shows a program for electronic control for the hydraulic elevator of this invention and the positions of limit switches which operate in correspondence with the respective operating stages of the elevator. This embodiment is a ram type hydraulic elevator wherein working oil is transferred from a tank 103 to a jack 104 or vice versa by means of a constant capacity type hydraulic pump 102 driven by a cage type induction motor 101, to move a ram 105 for the jack 104 up or down, thereby causing the elevator to ascend or descend. Hereunder, the operating functions of this hydraulic elevator will be successively explained of the respective stages of the stop, the slow speed ascent, the full speed ascent, the slow speed descent and the full speed descent of the elevator.

(A) Stage of Stop of Elevator

A power supply to the cage type induction motor 101 shown in FIG. 4 is open. An electronically-controlled variable flow solenoid valve for ascent 106 and an electronically-controlled variable flow solenoid valve for descent 107 have a control voltage V which is now zero, and the former is fully open, while the latter is fully closed.

Accordingly, the working oil is not transferred from the tank 103 to the jack 104. In addition, that movement of the working oil from the jacks 104 to the tank 103 which is attendant upon the natural fall of the elevator is checked by a non-return valve 109. Therefore, the elevator is in the perfectly stopped state.

(B) Stage of Slow Speed Ascent (Accelerating Ascent) of Elevator

The cage type induction motor 101 shown in FIG. 4 is started. The constant capacity type hydraulic pump 102 is driven by the forward rotation of the motor 101 so as to transfer the working oil from the tank 103 to the hydraulic circuit 111 through a filter for suction 110.

At the starting of the electric motor 101, the electronically-controlled variable flow solenoid valve for ascent 106 is fully open. Accordingly, the working oil is returned to the tank 103 through the variable flow solenoid valve 106, so that an oil pressure for raising the ram 105 is not generated in the jack 104.

The variable flow solenoid valve 106 is operated in accordance with the program for electronic control shown in FIG. 5. The axis of ordinates represents the control voltage V or current I for electronically controlling the variable flow solenoid valve, while the axis of abscissas represents the movement distance x or time t of the elevator.

As illustrated in FIG. 5, at the starting of the electric motor 101 (a position of $x=0$ or $t=0$), the voltage V is zero, and the variable flow solenoid valve 106 is fully open. As the voltage V increases in the positive direction, the variable flow solenoid valve 106 is gradually closed.

Accordingly, when the variable flow solenoid valve 106 is operated by a program section B corresponding to the slow speed ascent stage in FIG. 5, the oil pressure for raising the ram 105 does not appear in the jack 104 at the starting of the electric motor 101 because the variable flow solenoid valve 106 is fully open and all the working oil transferred by the constant capacity type hydraulic pump 102 is returned to the tank 103. With the increase of the control voltage V of the variable flow solenoid valve 106, however, this valve 106 is gradually closed, and the flow rate of the working oil which is transferred to the jack 104 through the non-return valve 109 increases, to generate the oil pressure for raising the ram 105.

With the increase of the voltage V, the ram 105 has its rising speed enhanced and brings the elevator into the accelerating slow speed ascent.

(C) Stage of Full Speed Ascent of Elevator

In case where the variable flow solenoid valve 106 is operated by a program section C corresponding to the full speed ascent stage in FIG. 5, the voltage V is held constant at its maximum voltage $V_c$, and hence, the variable flow solenoid valve 106 is held in the fully closed state or a slightly open state. In consequence, the elevator having been accelerated in the slow speed ascent stage comes to ascend at the full speed of a fixed speed.

The speed of the elevator during the full speed ascent can be adjusted to an appropriate value by properly setting the maximum voltage $V_c$ corresponding to the speed.

(B') Stage of Slow Speed Ascent (Decelerating Ascent) of Elevator

When the elevator has performed the full speed ascent to a position $x_1$ immediately below a floor intended to stop, a limit switch ULS-1 operates, and the variable flow solenoid valve 106 receives a deceleration signal. That is, the valve 106 is operated in accordance with a program section B' in FIG. 5.

The voltage V decreases from the maximum voltage $V_c$, and the variable flow solenoid valve 106 is consequently opened. Thus, the flow rate of the working oil to be transferred to the jack 104 decreases, and the ascending speed of the elevator lowers. A limit switch ULS-2 operates somewhat this side of a stop position $x_2$ of the floor intended-to-stop, and the elevator ascends at slow speed up to the stop position $x_2$ and then stops thereat. At this time, the electric motor 101 rotates for several seconds even after the elevator has reached the stop position $x_2$, whereupon it stops.

As described above, the elevator of this invention is operated very smoothly in accordance with the program of FIG. 5 and the limit switches ULS-1 and ULS-2 from the starting via the accelerating ascent, the constant full speed ascent and the decelerating ascent to the stop.

(D) Stage of Slow Speed Descent (Accelerating Descent) of Elevator

The electronically-controlled variable flow solenoid valve for descent 107 is operated by a program section D corresponding to the slow speed descent stage in the program for electronic control illustrated in FIG. 5. The variable flow solenoid valve 107 is constructed so as to gradually open as the control voltage V increases in the negative direction.

Upon the operation of the variable flow solenoid valve 107, an oil pressure is also applied to the electronically-controlled variable flow solenoid valve for ascent 106 so as to close this valve 106 with a "close" signal. In case where the variable flow solenoid valve 107 is operated in accordance with the program section D in FIG. 5 and is gradually opened with the increase of the voltage V in the negative direction, the working oil is transferred by a gravity on the elevator from the jack 104 through the variable flow solenoid valve 107 to the tank 103 while rotating and driving the constant capacity type hydraulic pump 102 and the electric motor 101 in the direction reverse to those during the ascent of the elevator. Numeral 117 designates a check valve which allows the variable flow solenoid valve 106 to secure a pilot pressure.

The elevator carries out the accelerating slow speed descent with the increase of the voltage V in the negative direction, and the constant capacity type hydraulic pump 102 is driven by the falling energy at this time.

When the elevator has descended from the stop position $x_2$ down to any desired position $x_3$ (corresponding to a point of time when the flow rate of the working oil which is returned from the jack 104 to the tank 103 by the rotation of the electric motor 101 is the maximum, in other words, a point of time when the descending speed is the maximum), the cage type induction motor 101 is energized and operated. This cage type induction motor 101 is forcibly driven by the hydraulic pump 102 and functions as an induction generator, so that the falling energy of the elevator can be converted into generative power in the induction generator.

(E) Stage of Full Speed Descent of Elevator

In case where the variable flow solenoid valve 107 is operated by a program section E corresponding to the full speed descent stage in FIG. 5, the voltage V is held constant at its maximum voltage $-V_e$, and the variable flow solenoid valve 107 is held in the fully open state or a slightly closed state. The elevator having been accelerated in the slow speed descent stage descends at the full speed of a constant speed, and the cage type induction motor 101 to operate as the induction generator is driven through the constant capacity type hydraulic pump 102 by the falling energy, to generate the electric power.

The speed of the elevator during the full speed descent can be set at an appropriate value by properly setting the maximum voltage $-V_e$. In order to lower the resistance of the variable flow solenoid valve 107 to the utmost, it is set in a range $Q_2$ in which the flow rate of the working oil to pass through the variable flow solenoid valve 107 becomes greater than the flow rate of the working oil $Q_1$ to be returned to the tank 103 through the hydraulic pump 102. To this end, a limit switch DLS-1 is operated somewhat before the decelerating descent stage D' so as to shift the operation to a stage in which the variable flow solenoid valve 107 can be controlled in accordance with the program for electronic control (the descent speed can be controlled by the valve 107). Thus, the elevator is smoothly subjected to the decelerating control.

(D') Stage of Slow Speed Descent (Decelerating Descent) of Elevator

When the elevator has descended at the full speed down to a position $x_4$, a limit switch DLS-2 operates, and the variable flow solenoid valve 107 operates in accordance with a program section D' in FIG. 5.

As the absolute value of the voltage V decreases from the maximum voltage $V_e$, the variable flow solenoid valve 107 is closed, and the flow rate of the working oil to be transferred from the jack 104 to the tank 103 decreases, and the descent speed of the elevator lowers. A limit switch DLS-3 somewhat before a stop position $x_5$ to apply a stop signal to the valve 107, so that the valve 107 is closed and that the elevator stops at the stop position $x_5$. The motor power supply is turned "off" before the operation of the limit switch DLS-3 somewhat later than the operation of the limit switch DLS-2.

As described above, the elevator of this invention is operated very smoothly in accordance with the program for electronic control in FIG. 5 and the group of limit switches appropriately disposed from the decelerating descent via the constant full speed descent to the decelerating descent, whereby a hydraulic elevator of high efficiency can be provided.

In case where at the stop, ascent or descent of the elevator in the respective zones of B, C and B' and D, E and D', the elevator has rapidly risen or rapidly fallen and the flow rate of the working oil has deviated from a set value on account of an unexpected trouble of any of the hydraulic pump, piping, the electric motor, the valve etc., an electronic flowmeter 108 detects the deviation of the working oil flow rate from the set value as a feedback signal, and the opening and closure of the electronically-controlled variable flow solenoid valve for ascent 106 or the electronically-controlled variable flow solenoid valve for descent 107 can be automatically adjusted with the feedback signal in order to regulate the flow rate of the working oil to the set value. Therefore, the operation of the elevator becomes still smoother, and a very excellent safety device is comprised.

The hydraulic elevator of this invention is equipped with a manual operation valve for confirming safety 112. In a routine inspection, under the state under which the power supply of the electric motor 101 is turned "off", a signal for descent is applied to the variable flow solenoid valve 107 and the manual operation valve for confirming safety 112 is opened so as to cause the elevator to fall rapidly. Thus, whether or not the safety device functions properly can be inspected.

The working oil tank 103 is equipped with a float switch 118 for detecting the liquid level thereof. This is a safety measure for checking the quantity of the oil in the tank.

In FIG. 4, numeral 113 designates a relief valve which determines the maximum pressure of the working oil, numeral 114 a check valve for preventing a negative pressure, numeral 115 a filter, and numeral 116 a pressure gauge.

Thus far, Embodiment 3 according to the hydraulic elevator of this invention has been described. In this embodiment, the variable flow solenoid valve for ascent 106 is constructed so as to be closed during the ascent of the elevator.

EMBODIMENT 4

Figure 6:
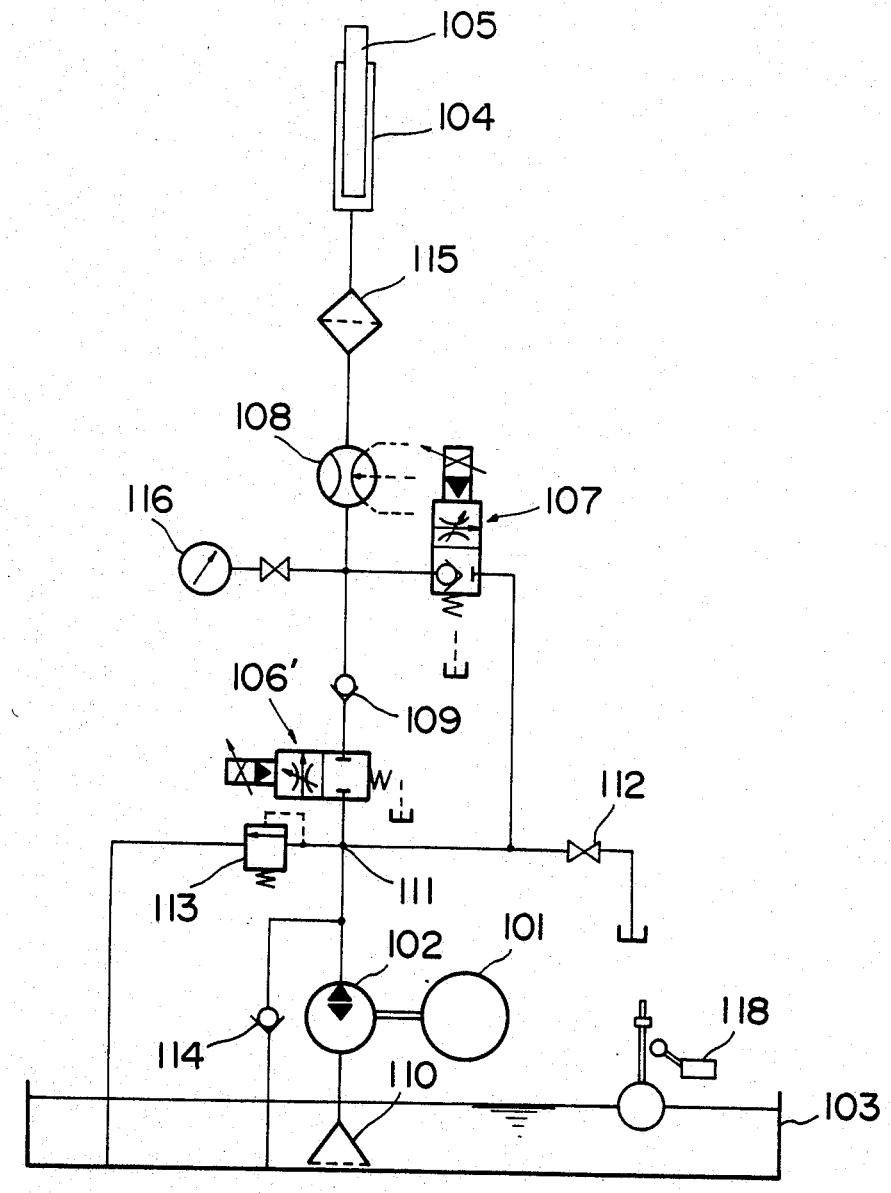
FIG. 6 illustrates a hydraulic circuit diagram showing Embodiment (4) according to the hydraulic elevator of this invention.

Now, Embodiment 4 according to the hydraulic elevator of this invention as is equipped with a variable flow solenoid valve adapted to open during the ascent is illustrated in FIG. 6. Likewise to Embodiment 3, the hydraulic elevator of Embodiment 4 is operated in accordance with the program for electronic control shown in FIG. 5. When the electric motor 101 is started and the constant capacity type hydraulic pump 102 is driven, a variable flow solenoid valve 106' opens by sensing the pilot pressure and brings the elevator into the slow spaced ascent (accelerating ascent) in accordance with the section B of the electronic control program in FIG. 5. As in Embodiment 3, the elevator performs the full speed ascent and the slow speed ascent (decelerating ascent) and leads to the stop in succession. The manner of the descent of the elevator is the same as in Embodiment 3, and is omitted from the description.

I claim:

1. A hydraulic elevator of the type in which a working oil is transferred from a tank to a jack having a ram, or vice versa, by means of a constant capacity type hydraulic pump so as to move said ram up and down to cause said elevator to ascend or descend, respectively, comprising:

a cage type induction electric motor in operable connection with a source of electric power and said pump, for driving said pump during ascent of said elevator, and for driving by said pump during descent of said elevator so as to feed generative electric power developed in said motor to said source of electric power;

hydraulic circuit means for conducting said working oil between said tank, said pump and said jack;

non-return valve means in said hydraulic circuit means between said pump and said jack for preventing the transfer of said working oil from said jack to said pump;

normally open electronically-controlled variable flow solenoid valve means in said hydraulic circuit for preventing the transfer of said working oil from said pump to said jack during starting of said motor means and also upon said ascending elevator's reaching a desired floor stop;

pilot control means in said hydraulic circuit means for applying a hydraulic pressure signal from said hydraulic circuit means to said normally open electronically-controlled variable flow solenoid valve to cause said valve to close;

normally closed electronically-controlled solenoid valve means in said hydraulic circuit means in parallel between said non-return valve means and said pump at one end and said tank at another end, for preventing the transfer of said working oil from said jack to said tank during ascending of said elevator and from said jack to said pump when said elevator is stopped at a desired floor stop;

electronic control means for ascent for starting said motor and for gradually closing said normally open electronically-controlled variable flow solenoid valve means once said motor is started, to cause said working oil to be transferred at a gradual rate of flow by said pump from said tank to said jack to cause said elevator to begin to ascend at a slow speed; for closing said normally open electronically-controlled variable flow solenoid valve means completely when said elevator has begun to ascend at said slow speed, to cause said working oil to be transferred by said pump at a maximum output rate of flow to said jack to cause said elevator to further ascend at an accelerating speed; for maintaining said normally open electronically-controlled variable flow solenoid valve closed completely upon said further ascending of said elevator, to cause said working oil to continue to be transferred by said pump to said jack at said maximum output rate of flow to cause said elevator to ascend at a maximum speed; for gradually opening said normally open electronically-controlled variable flow solenoid valve means as said elevator approaches a desired floor stop, to cause said working fluid to be transferred by said pump to said jack at a decreasing output rate of flow to cause said elevator to further ascend to said desired floor stop at a decelerating speed; and for causing said normally open electronically-controlled variable flow solenoid valve means to assume its normally open state, to cease the transfer of said working oil from said pump to said jack, and to stop said motor when said elevator has ascended to said desired floor stop;

electronic control means for descent for gradually opening said normally closed electronically-controlled variable flow solenoid valve, to cause said working oil to be transferred, under the influence of gravity acting upon said elevator, from said jack through said pump to said tank, and to apply a hydraulic pressure signal to said pilot control means to close said normally open electronically-controlled variable flow solenoid valve, to cause said pump to rotate and drive said motor and to cause said elevator to descend at a slow speed; for opening said normally closed electronically-controlled variable flow solenoid valve completely to transfer said working oil at an increasing rate of flow from said jack through said pump to said tank to cause said motor to be driven at an increasing speed and to cause said elevator to descend at an accelerating speed; for maintaining said normally closed electronically-controlled variable flow solenoid valve completely open to cause said working oil to be transferred from said jack through said pump to said tank at a maximum output rate of flow to drive said pump and said motor at a maximum speed, and while maintaining said normally closed electronically-controlled variable flow solenoid valve completely open, energizing said motor so as to cause said motor to be driven as a generator by said pump to supply electrical power to said source of electrical power, and to cause said elevator to descend at a maximum speed; for controlling said normally closed electronically-controlled variable flow solenoid valve such that the rate of flow of said working oil transferred therethrough is greater than the rate of flow of said working oil through said pump to said tank; for gradually closing said normally closed electronically-controlled variable flow control valve to cause said working oil to be transferred from said jack through said pump to said tank at a decreasing rate of flow as said elevator approaches a desired stop floor to cause said elevator to descend at a decelerating speed; and for causing said normally closed electronically-controlled variable flow solenoid valve to assume its normally closed state to cease the transfer of said working oil from said jack when said elevator has descended to said desired floor stop and to de-energize said motor; and an electronic flow meter in said hydraulic circuit means between said non-return valve means and said jack and in operable connection with both said electronic control means for ascent and descent, for detecting deviation of the rate of flow of said working oil from a set value and for applying a feedback signal corresponding to said deviation to said electronic control means for ascent and descent to cause said normally open and normally closed electronically-controlled variable flow solenoid valves to be adjusted to cause said rate of flow of said working oil to be regulated to said set value.

2. A hydraulic elevator as defined in claim 1 wherein said electric motor rotates in a forward direction during the ascent of said elevator and rotates in a reverse direction during the descent of said elevator.

3. A hydraulic elevator as defined in claim 1, further comprising:

first limit switch means in operable connection with said electronic control means for ascent, said first limit switch means operating when said elevator ascends to a position immediately below a desired floor stop to cause said normally open electronically-controlled variable flow solenoid valve means to open gradually to cause deceleration of the ascent of said elevator;

second limit switch means in operable connection with said electronic control means for ascent, said second limit switch means operating immediately before said elevator has ascended to said desired floor stop to cause said normally open electronically-controlled variable flow solenoid valve means to open when said elevator has ascended to said desired floor stop;

third limit switch means in operable connection with said electronic control means for descent, said third limit switch means operating during full speed descent of said elevator to permit the descent speed of said elevator to be controlled by said normally closed electronically-controlled variable flow solenoid valve;

fourth limit switch means in operable connection with said electronic control means for descent, said fourth limit switch means operating to cause said normally closed electronically-controlled variable flow solenoid valve to begin closing gradually to cause deceleration of the speed of descent of said elevator; and fifth limit switch means in operable connection with said electronic control means for descent, said fifth limit switch means operating immediately before said elevator has descended to a desired floor stop to cause said normally closed electronically-controlled variable flow solenoid valve to assume its normally closed state.

* * * * *